US007357737B1

(12) United States Patent
Cutler

(10) Patent No.: US 7,357,737 B1
(45) Date of Patent: Apr. 15, 2008

(54) REMOVABLE, REPLACEABLE, MULTIWIDTH CROQUET WICKET BRACKET

(76) Inventor: William Brainard Cutler, Box 635, Mystic, CT (US) 06355

( * ) Notice: Subject to any disclaimer, the term of this patent is extended or adjusted under 35 U.S.C. 154(b) by 0 days.

(21) Appl. No.: 11/443,521

(22) Filed: Jun. 28, 2006

Related U.S. Application Data

(60) Provisional application No. 60/685,362, filed on May 27, 2005.

(51) Int. Cl.
*A63B 67/00* (2006.01)

(52) U.S. Cl. ..... 473/411

(58) Field of Classification Search ..... 473/410–412, 473/405, 407, 170, 175–179; 116/209
See application file for complete search history.

(56) References Cited

U.S. PATENT DOCUMENTS 431,421 A * 7/1890 Prentice et al. ..... 473/411
2,583,493 A * 1/1952 Prentice et al. ..... 473/411
3,823,942 A * 7/1974 Duncan ..... 473/514
4,149,719 A * 4/1979 Wakefield ..... 473/176
4,275,535 A * 6/1981 Stalzer ..... 52/100
4,910,902 A * 3/1990 Anderson ..... 40/607.06
5,089,803 A * 2/1992 Bohn ..... 340/425.5
5,377,944 A * 1/1995 Getsinger ..... 248/218.4
6,349,667 B1 * 2/2002 Rogers et al. ..... 116/209

FOREIGN PATENT DOCUMENTS

GB 2358357 A * 7/2001

* cited by examiner

*Primary Examiner*—Mark S Graham

(57) ABSTRACT

A horizontal plate has a plurality of tubes attached which in this embodiment are spaced and oriented to accept croquet hoops of various widths and sizes. The hoops are easily insertable, removable and reinsertable into the channels. The plate support maintains the dimensional and special positioning of the hoops as well as providing robust caroming characteristics.

4 Claims, 1 Drawing Sheet

REMOVABLE, REPLACEABLE, MULTIWIDTH CROQUET WICKET BRACKET

CROSS-REFERENCE TO RELATED APPLICATIONS

This Application Claims Priority of Provisional Application U.S. 60/685,362, Filing Date May 27, 2005

FEDERALLY SPONSORED RESEARCH

Not Applicable

SEQUENCE OR PROGRAM LISTING

Not Applicable

BACKGROUND OF THE INVENTION

1. Field

In one embodiment this invention relates to sports equipment, Specifically croquet wickets.

2. Background of the Sport

Croquet is enjoyed in all parts of our country and the world beyond where it was carried throughout the reaches of the British Empire. The sport has enjoyed episodic fads, banned in Boston in the 1800's because of rowdy behavior and in 1900 enjoying the status of an Olympic event. Today Croquet is most frequently played informally, amenable to family and social gatherings without regard to age or gender. It is also played more seriously with regional tournaments and even international team events. In this country there is reported to be some 300 clubs under the aegis of the United States Croquet Association (USCA) which functions along with the Croquet Association (Association) in England to provide event coordination, uniformity of rules, equipment specifications and dispute resolution. The fifteen member World Croquet Federation serves to coordinate on an international basis.

In this country croquet is most frequently played outdoors, on the ground within a delimited area. The object of the game is to use a mallet to strike a ball and propel it through "wickets" (inverted U-shaped wireforms) which are set in the ground of the playing area in a pattern according to formal rules or less formally by agreement of the participants. Stroking differentiatingly colored balls in turn, individually or in teams, the object is to complete passing through the agreed pattern of wickets in fewer turns than competitors. Striking posts may be added to mark passage through stages of the pattern. The rules may also include added turns as rewards for hitting competitors' balls. In the United States the 9-wicket game is the most popular with play of the 6-wicket "Association" game more prevalent in elitist settings. Other variants include Golf Croquet, (popular in Egypt) and Xtreme Croquet, remarkable for its expansion of the playing area. (Examples of game rules and court layouts are available from the United States Croquet Association.)

At its simplest, with the cry, "Let's play croquet", an area of ground is selected, two striking posts ("stakes") are driven, wickets are placed, partners may be chosen; an order of play determined, various rules adopted and the game started, all quite informally. Such informal games are generally played under the USCA 9-wicket rules or bearing some resemblance thereto. In contrast, at its most formal the game is played under Association 6-wicket rules. Most such venues are croquet clubs where the surface (grass or artificial) is meticulously level and groomed, players dressed in whites, scoreboards in use, perhaps paid coaches and an umpire present, expensive custom made mallets and other upscale equipment, visiting international players for major tournaments, all quite a contrast to the home style situation. Equipment in use reflects the tastes and pocketbooks of the players involved. The 9-wicket and the 6-wicket games are differentiated by the number of wickets, the pattern of layout and the character of wickets. The 9-wicket hoops tend to be of lighter wire stock (representatively ⅜"), bent to shape, while the 6-wicket hoops are generally welded ⅝" steel.

Typically, as interest in the game develops, details become of greater concern to the players. For one thing, the surface of the court becomes more important. Since most courts are grass, they require regular mowing. For this to be done efficiently it is necessary to remove the wickets to allow the lawn mowers to freely move over the playing area or "court". In the upper strata of play great care is taken to reinsert the wickets in the playing surface, firmly and precisely in the correct spots.

There is another factor involved. An important element of play is the interaction when the ball strikes a wicket. Strong wickets allow the balls to hit and carom, either bouncing away, passing through the wicket or stopping when only partially through (becoming "wicketed"). The heavy Association wickets are able to provide the structural resistance to give the balls good bounce and withstand the force of blows from hard struck balls. The lighter wickets often have an irregular reaction and are subject to being knocked over or collapsing.

A further controllable variable between various levels of play is the "gape" of the wickets. The Association specifies International level, "A" Class wickets to have a 3¾" opening, tight when the balls are specified at 3⅝" diameter, leaving only 1/16" clearance on each side. Our experience has shown that 4½" or 5" gapes are challenging for beginners and even players of moderate competence, while permitting faster play. It is an advantage to be able to quickly convert sizes. For example in a croquet instruction setting a class of learners could be followed by experts with little loss of time, heretofore a cumbersome chore. This interchangeability is a significant advantage.

Another important advantage of this embodiment is that it makes it easier to adapt a playing surface to multiple uses. One leading combination is the interchangeability of use with Lawn Bowls which has seen a number of installations. Beyond this is the interchangeability with tennis. Experimentation has shown that a tennis court surface has a ball speed which is suitable for croquet. Removability and replaceability of the wickets make such adaptations easier.

A further expansion of use can be expected from the increased adoption of artificial surfaces. Until the last few years, most lawn games depended on grass which is expensive to maintain. Artificial surfaces such as AstroTurf™ and tennis court surfaces are now being used for many games. Growing realization of this can be expected to increase their installation. Lights can also add to the appeal of croquet as has been the case in football, baseball and other sports.

3. Prior Art

There have been many developments in the field of croquet. For the large part they deal with the matters of (a) night play (b) detection and recording passage through wickets (c) boxes for transporting equipment and (d) variations in the game, such as circular patterns, holes instead of wickets, etc. The following are exemplary of such developments:

| U.S. Pat. No. | Date | Inventor | Nature of Invention |
|---|---|---|---|
| 54,848 | May 1866 | M. Bradley | Sockets to support wickets |
| 1,583,244 | May 1926 | Burris | Variety of croquet elements |
| 1,583,250 | May 1926 | Heath | Variety of croquet elements |
| 5,509,651 | April 1996 | Webster | Croquet Wicket and Stake System for arenas |

Bradley shows sockets (plugs) which are individually insertable into the ground and receive the wicket legs. This unconnected arrangement provides neither dimensional nor coplanary control, hardly satisfactory for players of any taste. Burris and Heath show a medley of "croquet" equipment elements, an imaginative panorama of hazards and gadgetry much of which is not croquet and none of which individually or in combination, provides a robust arrangement. Webster shows a support designed for indoor use and is, however, of a nature such that its physical support is gained through invasive intrusion into the playing surface, ineffective in providing stability outdoors.

Pictures of contemporary hoops are available on the Internet at sites maintained by croquet interest groups, manufacturers and venders. Among the wickets exhibited, a British Patent, GB2,358,357 to Golesworthy (2001), the "Omega" wicket, emerged from Environmental Development Technology, Ltd, an arm of the British Coal Board (technologically comparable to NASA in the US). Its operation is based on rotatable screws in which the uprights are eccentrically mounted. Turning the base screws alters the gape. This wicket lacks dimensional maintenance so that during play it can loosen, changing the gape. Removal and replacement is tedious since it is not secure in the ground and when being reinserted requires remeasurement of the gape with probable readjustment. It also is expensive

BRIEF SUMMARY OF THE INVENTION

According to one embodiment, a bracket plate with tubular channels attached or incorporated therein, which hold one or more elements securely as a result of insertion into one or more of the channels, specifically a croquet wicket.

Advantages

This embodiment fills needs in a manner superior to other devices (i) easy installation with no special ground preparation required (ii) easy restoration of wicket location after removal (iii) staunch interaction of balls with wicket (iv) ability to easily adjust wicket width to various levels of play.

(v) useable on a variety of surfaces, indoor and outdoor (vi) adaptable to most croquet rules in use at this time (vii) maintenance of dimensional requirements ("gape")

(viii) facilitates transition between 6wicket and 9wicket configuration (ix) adaptable to less expensive production methods with increased volume (plastics)

There are many additional uses for this device, croquet wickets being the embodiment set forth herein. Indeed, in croquet there are several variations in the layout and play of the game beyond the most common which are the 9wicket American Rules game and the 6wicket International Rules game. Other embodiments may have a greater number or fewer tubular elements in various orientations where a specified relationship and spatial stability between the inserted elements is essential.

SUMMARY

This embodiment is a bracket plate, holding elements securely by insertion into tubular channels attached or incorporated into said plate, specifically a croquet wicket.

Figure 1:
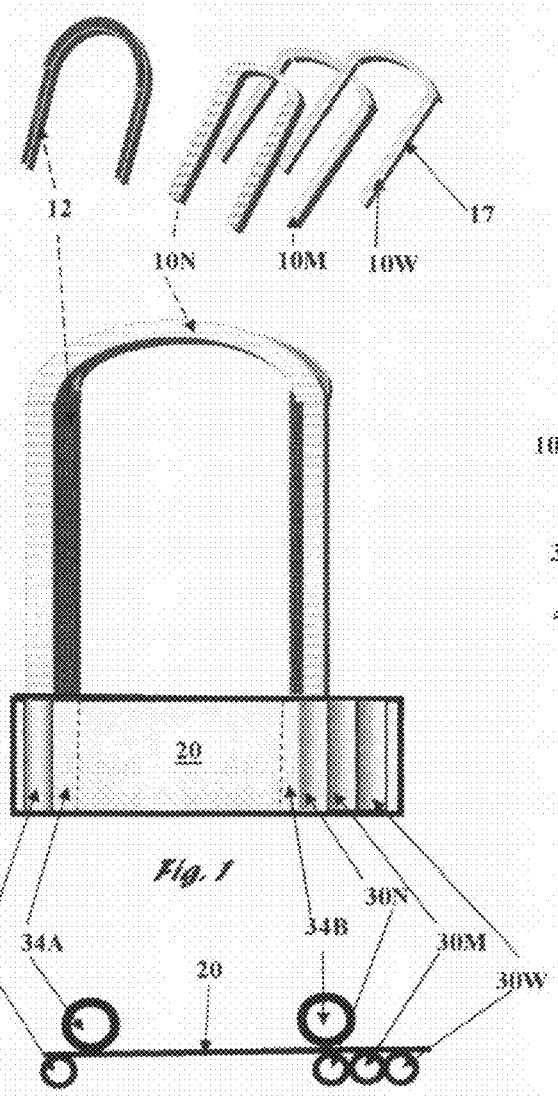
FIG. 1 is a facing view showing the plate 20 which is not inserted into the playing surface 40. Four different sized hoops are shown, 10N, 10M and 10W (wide, medium and narrow as chosen for use, most likely in the 9wicket game) and hoop 12 which conforms with the 6wicket rules. All are shown to be inserted in the channels 30, 30N, 30M and 30W and 34A and 34B. In actual practice, only one hoop at a time would be deployed into the bracket. Each of the hoops 10N, 10M and 10W have two legs but when individually deployed they each use channel 30 only four channels are required.
Figure 2:
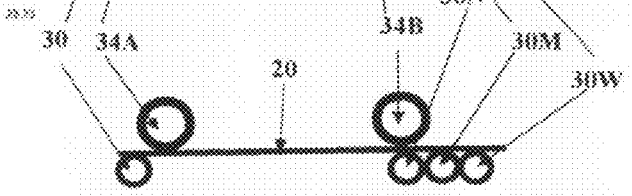
FIG. 2 is a plan view showing the channels 30, 30N, 30M, 30W 34A and 34B and their relationship when attached to the plate 20 in this embodiment.
Figure 3:
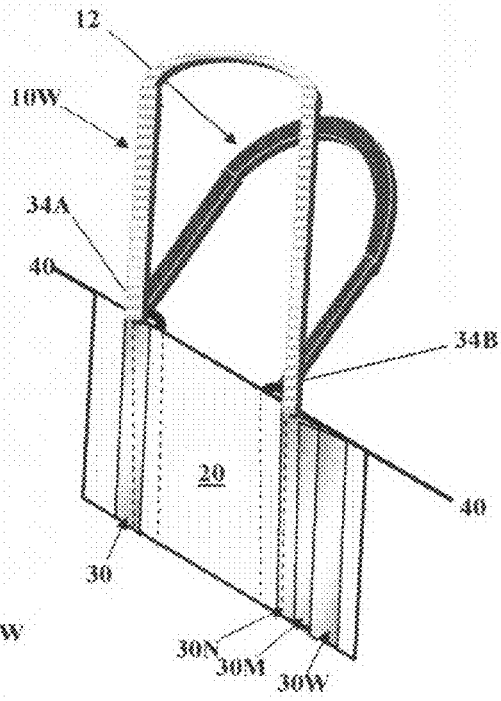
FIG. 3 is an isometric view showing plate 20 positioned in the ground 40. Hoop 12 is in the process of being inserted or removed.

NUMBERED PARTS LIST AND NOMENCLATURE arch, hoop (interchangeably)—in this embodiment, wire forms 10N, 10M, or 10W bent in a Ushape with "gapes" sized to be progressively wider than 3¾", or as convenient, wire form 12 of a 3¾" gape, which are inserted into appropriate tubular channels 30, 30N, 30M, 30W or 34A and 34B which channels are attached to the plate 20 at predetermined locations and orientations.

bracket—the plate 20 and the attached tubular channels 30, 30N, M and W and 34A and B.

channels—tubular elements 30, 30N, 30M, 30W and 34A and 34B which are attached to plate 20.

gape—in a croquet hoop the opening between the uprights of the U-shaped wire forms, expressed as a dimension leg(s)—upright element(s) of the Ushaped wireforms wicket—in this embodiment the assembly of appropriate arches 10N, 10W or 12, inserted into channels, which assembly, when embedded in the proposed surface 40 is the structural element through which the ball is propelled in playing croquet.

| Drawing Reference No | Term | Description |
|---|---|---|
| 10N, 10M, 10W | Arch, hoop | Wireforms of selectable sizes used in 9wicket game. |
| 12 | Arch, hoop | arch 12 is used in 6 wicket game and generally is heavier wire than arches 10N and 10W |
| 17 | Leg | Up right elements of arch |
| 20 | Plate | The member to which the channels 30, 30N, 30M, 30W and 34A and 34 B are attached |
| 30 | Channel | Tubular sleeve mounted on plate 20 to receive one leg of arches 10N, 10M or 10W |

-continued

| Drawing Reference No | Term | Description |
|---|---|---|
| 30N, 30M, 30W | Channel | Tubular sleeves mounted on plate 20 to receive one leg of arches 10N, M, or W |
| 34A and 34B | Channel | Tubular sleeves mounted on plate 20 to receive legs of arch 12 |
| 40 | ground level | The level of the surface into which the bracket 20 is placed. |

In this embodiment, my invention comprises the basic elements of an arch 10N, 10M, 10W or 12, and a plate 20 to which are attached tubular channels 30, 30N, 30M, and 30W and which when assembled in a unit, form a croquet wicket with a gape as determined by the arch chosen.

The embodiment and formulation described here does not limit further embodiments. Thus, while the prototype was made of steel, some other metal or plastic, wood or combination of materials may be chosen in the future. The dimensions and proportions are also variable without compromising the essence of this invention. The principle can also be used in other embodiments wherever there is a need to accurately position embedded elements.

DESCRIPTION

In one embodiment which is chosen as representative but not as limiting, the bracket is made of commercially available ferrous materials and the plate 20 3/16" stock cut 4"×6". There are two sets of channels. One set, the channels 30,30N, 30M, and 30W are 3/8" tubing in 4" lengths. These channels are welded to one side of the plate 20, positioned on the plate 20 across the width, perpendicularly to the top. One of the channels is at one end of the plate 20 and the others at the desired distances from the first, in this embodiment the distance between the channel centers is 4½" and 5½". In this embodiment, hoops 10N, 10M, and 10W are dimensioned appropriately for the 9wicket game, made from 3/8" wire bent into a U shape with legs 17 of 16" and a cross member of the same length as the desired distance between channels 30, 30N, 30M, and 30W previously described. Therefore when the legs 17 are thrust into the plate 20 and the plate 20 urged into the ground, 12" of each leg is above the ground with an additional length required to form the cross member at the top. Thus each length of wire is 32" plus the width across the top. The tubular channels 30, 30N, 30M, 30W and 34A and 34B are welded to the plate 20 with an orientation such that when the plate is vertical in the x, y and z axes the channels are also so oriented. This foregoing arrangement has been selected to accommodate two sizes of hoops (4½" and 5½") for the 9wicket game.

In this embodiment, a second set of channels has been arranged to accommodate a second set of hoops, which in this case conform to 6wicket Association rules. The channels 34A and 34B are welded to plate 20 on the opposite side from channels 30,30N, 30M, and 30W. Since Association standards require 5/8" bar stock, the channels 34A and 34B must be sized appropriately and spaced to an inside diameter so that the gape between the legs is 3¾".

OPERATION OF THE INVENTION

The brackets (the assembly of plate 20 and channels 10N, 10M, 10W and 34A and B) are persuaded into the playing surface 40 in the desired location or location. The size of the arches to be used is determined and the arches inserted into the appropriate channels. When for any reason, such as but not limited to, lawn mowing, another use for the ground, or appearance, it is desired to remove the inserted arches, it is rather simple to lift them out. Restoring is the reverse of this process. Since the top of the bracket is level to the ground, rediscovery of the location can be facilitated by the use of a spot of white athletic field marking paint.

In use, the brackets with channels incorporated are persuaded into the ground 40 so that the side is level with the surface. The placement of the bracket is in accordance with the desire of the participants and may be in conformance with rules published or anecdotal. It is expected that almost always, similarly sized hoops will be used in any game. The bracket can be configured to accept various sized elements. When used in croquet, generally only one size of hoop would be in use at a time. However, the opportunity is available to use various sizes of hoops, thus adding an element of variety to the game Other uses with other configurations, insertable elements and plate dimensions are possible.

I claim:

1. A croquet wicket holder for holding croquet wickets in playing surfaces, said holder comprising a rectangular plate to which are attached, or into which are incorporated, a plurality of parallel tubes arrayed in a manner to maintain several different preset dimensional and spatial relationships of the legs of croquet wicket hoops when inserted into the tubes, two of said tubes spaced to provide the regulation width for a croquet wicket hoop, said tubes adapted to hold the wicket hoop legs removably in a substantially vertical orientation, said plate adapted to be inserted vertically into a playing surface and maintain the tubes in a vertical orientation.

2. A croquet wicket holder as in claim 1 wherein some or all of the holder is made of metal.

3. A croquet wicket holder as in claim 1 wherein some or all of the holder is made of plastic.

4. A croquet wicket holder as in claim 1 wherein some or all of the holder is made of non-ferrous material.

* * * * *